United States Patent [19]

Yamada

[11] 3,970,047

[45] July 20, 1976

[54] REDUCED PRESSURE TYPE STEAM GENERATOR

[75] Inventor: Sadakazu Yamada, Kyoto, Japan

[73] Assignee: Stotz & Co. AG, Zurich, Switzerland

[22] Filed: Mar. 17, 1975

[21] Appl. No.: 559,371

[30] Foreign Application Priority Data

Mar. 18, 1974 Japan ..... 49-31192

[52] U.S. Cl. ..... 122/13 R; 122/33; 55/158

[51] Int. Cl.[2] ..... F22B 5/00

[58] Field of Search ..... 122/13, 33, 37; 55/158; 220/273

[56] References Cited

UNITED STATES PATENTS

| | | | |
|---|---|---|---|
| 2,298,938 | 10/1942 | Griffin, Jr. et al. | 220/273 |
| 2,635,784 | 4/1953 | Bering et al. | 220/273 |
| 3,342,729 | 9/1967 | Strand | 55/158 |
| 3,762,136 | 10/1973 | Kimura | 55/158 |
| 3,815,552 | 6/1974 | Koula | 122/37 |

*Primary Examiner*—Kenneth W. Sprague
*Attorney, Agent, or Firm*—Werner W. Kleeman

[57] ABSTRACT

A reduced pressure type or vacuum steam generator comprising an air tight steam chamber or compartment, the inside of which is maintained at reduced atmospheric pressure or vacuum conditions and containing a heat medium liquid. At the top of the steam chamber there is provided a gas reservoir having an outlet for permeating out a non-condensible gas and which outlet is covered with a polymer film.

5 Claims, 2 Drawing Figures

REDUCED PRESSURE TYPE STEAM GENERATOR

BACKGROUND OF THE INVENTION

The present invention relates to a reduced pressure type steam generator equipped with an air tight steam chamber or compartment which is maintained at reduced atmospheric pressure or vacuum conditions and within which there is contained a heat or heatable medium liquid, and at the top of the steam chamber there is provided a gas reservoir with an outlet covered with a polymer film for permeating out a non-condensible gas.

The so-called reduced pressure type or vacuum steam generator wherein water or another heatable medium is enclosed in the air tight vessel of the generator and wherein the heatable medium is heated by a heat source, such as gas or oil, and a heating pipe is introduced into the vessel in order to be indirectly heated by the vapors of the heatable medium and connected with a hot water supply tap or heating equipment, has certain advantages in that its handling is safer and its heat transfer is superior inasmuch as the vessel is operated at reduced pressure or vacuum conditions. However, such equipment also has certain drawbacks or limitations, such as the introduction of air at the joint locations between the vessel and auxiliary equipment or accessories or impaired heat transfer due to generation of non-condensible gas, such as hydrogen, by virtue of electro-chemical reactions. The introduction of air at the joints or joint locations can be prevented if adequate precautions are taken with respect to the construction of the joints or through appropriate selection of the packing material. However, it is extremely difficult to prevent the generation of hydrogen gas due to elecro-chemical reactions and a non-condensible gas such as hydrogen has heretofore been exhausted according to conventional techniques from the vessel within which such gas is generated by the use of a vacuum pump or ejector.

SUMMARY OF THE INVENTION

It is a primary object of the present invention to provide an improved construction of reduced pressure type steam generator wherein the hydrogen gas generated in the vessel of the steam generator is permeated out by means of a polymer film having the special property of permeating the gas by partial pressure inasmuch as the gas which is generated is mainly hydrogen.

According to the invention there is provided a novel construction of reduced pressure type steam generator or vacuum steam generator equipped with an air tight steam chamber, the interior of which is maintained at reduced atmospheric pressure or vacuum conditions and containing a heatable liquid medium. At the top of the steam chamber there is connected a gas reservoir equipped with an outlet covered by a polymer film for permeating out a non-condensible gas.

BRIEF DESCRIPTION OF THE DRAWING

The invention will be better understood and objects other than those set forth above, will become apparent when consideration is given to the following detailed description thereof. Such description makes reference to the annexed drawing wherein.

DETAILED DESCRIPTION OF THE PREFERRED EMBODIMENTS

Figure 1:
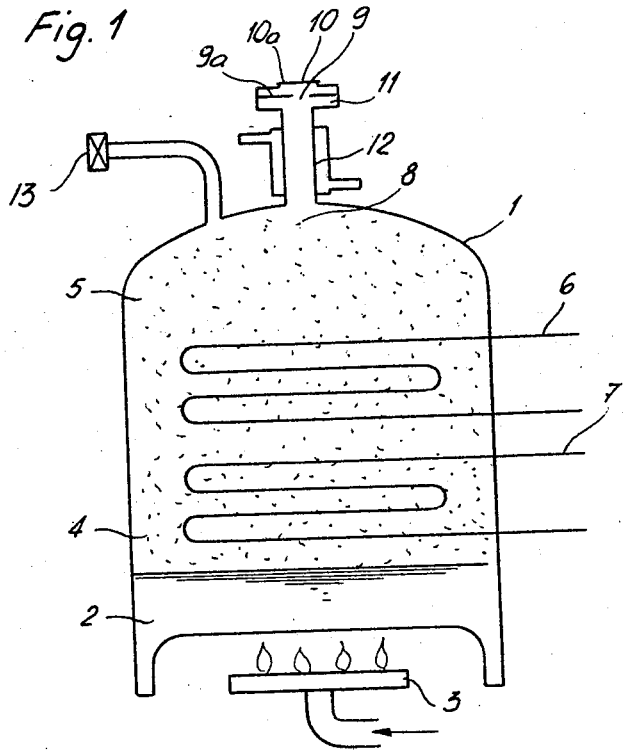
FIG. 1 is a longitudinal section view of a reduced pressure type or vacuum steam generator constructed according to the invention; and sectional

Describing now the drawing, in FIG. 1 there is schematically illustrated in cross-sectional view an exemplary embodiment of reduced pressure type steam generator —also known in the art as a vacuum steam generator— which comprises an air tight vessel 1 in which there is enclosed a heatable liquid medium 2, such as typically water for instance, but another type of suitable liquid medium could be employed. The heatable liquid medium 2 is heated by a suitable heating device 3 installed beneath the air tight vessel 1 and thus there is produced steam at reduced pressure and which steam has been generally indicated by reference character 4. The air tight vessel 1 encloses a steam chamber or compartment 5 and, as best seen by referring to FIG. 1, a hot water supply pipe or conduit 6 extends into the steam chamber 5 as does also a heating pipe 7 for heating purposes.

At the top of the steam chamber 5 there is arranged a gas reservoir 11 for a non-condensible gas such as hydrogen, gas reservoir 11 being connected in flow communication via a conduit or pipe 12, for instance a lead pipe, with the steam chamber 5. The gas reservoir 11 is provided with a pierced hole 9 formed in a plate or the like, schematically indicated by reference character **9*a* therein and the top of the gas reservoir has an opening 10*a* covered by a polymer film 10, for instance formed of polystyrene, polycarbonate and so forth. Any non-condensible gas, such as hydrogen, which is formed in the system moves through the conduit 12 into the gas reservoir 11 then through the hole or bore 9 and reaches the outlet opening 10*a* covered by the polymer film 10** through which permeates the aforesaid non-condensible gas.

In the embodiment under discussion, although the temperature of the steam generated in the air tight vessel 1 is below 100°C the lead pipe 12 is formed as a slender tube and connected to the vessel so that the pipe is cooled by heat radiation from the surface or by cooling water and the temperature of the polymer film is maintained at the specified temperature and at the same time only the non-condensible gas, such as hydrogen, produced in the vessel is collected in the gas reservoir 11 via the lead pipe 12 and is permeated out or expelled into the ambient air through the polymer film 10.

Figure 2:
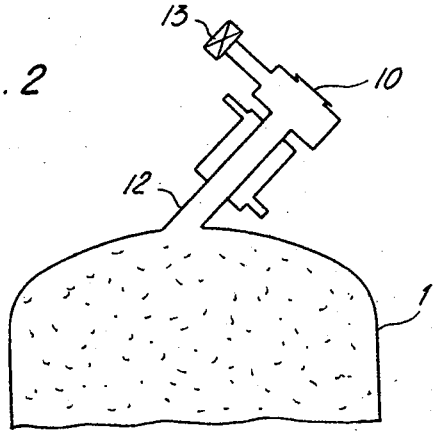
FIG. 2 is a schematic fragmentary view of a modified detail of the steam generator shown in FIG. 1.

If the diameter of the lead pipe 12 is too small then the condensate 8 may remain in the pipe and locally seal such pipe. Therefore, in such case the lead pipe is advantageously attached to the vessel 1 at an inclination of 45° to 75° with respect to the vertical axis of the steam generator as the same has been shown in the modified arrangement of FIG. 2, so that there is a smooth transfer of hydrogen gas to the gas reservoir 11 as well as a smooth downflow of condensate into the steam chamber, and the non-condensible gas remaining in the vessel can be completely exhausted by installing an air vent hole 13 at the top of the gas reservoir in case of gas scavaging. It will be seen that in the arrangement of FIG. 1 the air vent hole is disposed at the top of the vessel 1.

There is preferred a gas permeability ratio which is greater than 5 between hydrogen and air $PH_2/(PO_2+PN_2)$ and ratio greater than 10 is most preferred, and wherein the gas permeability of polystyrene and polycarbonate is as follows:

| | Temperature °C | Gas Permeability $PH_2$ ($P \times 10^{9cc.cm}/cm^2.Sec.CmHg$) | $PO_2$ | $PN_2$ | Gas Permeability Ratio $PH_2/(PO_2 + PN_2)$ (Same as written at the left) |
|---|---|---|---|---|---|
| Polystyrene | 20 | 1.89 | 0.25 | 0.09 | 5.5 |
| Polycarbonate | 20 | 0.914 | 0.10 | 0.10 | 8.4 |

As experimentation with the inventive equipment has shown the non-condensible gas of 435 cc produced in the steam chamber after 6 months operation of the reduced pressure type steam generator of 15,000 Kcal/h output, was composed of 98% hydrogen and 2% nitrogen, however when the non-condensible gas reservoir attached with a polycarbonate film of 0.5 millimeters thickness, 40 millimeters diameter was installed at the top of the steam chamber, the non-condensible gas of 45 cc produced in the steam chamber after 6 months operation was composed of 45% hydrogen, 45% nitrogen and 10% oxygen. The gas volume accummulated in the vessel is inclined in order to increase during the above-mentioned operation, however, the hydrogen produced in the vessel can be easily permeated out or expelled through the polymer film as shown by the permeability ratio $PH_2/(PO_2 + PN_2) = 8.4$ between hydrogen and air in the case of polycarbonate. In this case the oxygen permeated into the vessel through the polymer film is almost consumed in the vessel as shown in the following formula regarding the deoxidation reaction of oxygen, $$\frac{1}{2}O_2 + H_2O + 2e - 2O\ H^-$$

therefore, the gas permeability ratio becomes $PH_2/PN_2$ and the ratio is further increased, and the volume of non-condensible gas remaining in the vessel can be suppressed to a minimum.

As explained above, the conventional way of exhausting considerable quantities of non-condensible gas by means of a vacuum pump when such gas has accummulated, is not only inconvenient in handling but also brings about a change in the performance of the steam generator before and after the exhausting operation. However, in contrast thereto the present invention enables permeating out the non-condensible gas produced in the vessel automatically and continuously because the permeability of gas due to partial pressure of polymer film is utilized and also prevent impairment of heat transfer caused by the non-condensible gas, and there can be expected a stable performance of the reduced pressure type steam generator or steam generator operating according to the vacuum principle as designed according to the invention.

While there is shown and described present preferred embodiments of the invention, it is to be distinctly understood that the invention is not limited thereto, but may be otherwise variously embodied and practiced within the scope of the following claims.

What is claimed is:

1. A reduced pressure type steam generator comrising a vessel containing therein an air tight steam chamber, the interior of said vessel being maintained at reduced atmospheric pressure, a heatable liquid medium enclosed in the vessel, a gas reservoir connected with the top region of the vessel, said gas reservoir being equipped with an outlet covered with a polymer film for permeating out any non-condensible gas formed in the vessel.

2. The reduced pressure type steam generator as defined in claim 1, wherein the gas reservoir is inclined with respect to the vertical axis of the vessel at an angle in the order of about 45° to 75°.

3. The reduced pressure type steam generator as defined in claim 1, wherein the polymer film is formed of polystyrene.

4. The reduced pressure type steam generator as defined in claim 1, wherein the polymer film is formed of polycarbonate.

5. The reduced pressure type steam generator as defined in claim 1, wherein the gas reservoir is connected with the top region of the vessel through the agency of a pipe connection and in flow communication with the steam chamber.

* * * * *